US006325055B1

(12) United States Patent
Yokoyama et al.

(10) Patent No.: US 6,325,055 B1
(45) **Date of Patent: *Dec. 4, 2001**

(54) FLOW CONTROL VALVE

(75) Inventors: Hisashi Yokoyama; Toshihiko Miyake, both of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,819

(22) PCT Filed: Mar. 25, 1998

(86) PCT No.: PCT/JP98/01327

§ 371 Date: Aug. 23, 1999

§ 102(e) Date: Aug. 23, 1999

(87) PCT Pub. No.: WO99/49203

PCT Pub. Date: Sep. 30, 1999

(51) Int. Cl.[7] ..... F02M 25/07
(52) U.S. Cl. ..... 123/568.24; 251/129.11
(58) Field of Search ..... 123/568.24, 568.23, 123/568.21; 251/129.11, 129.12, 129.13, 322; 137/338

(56) References Cited

U.S. PATENT DOCUMENTS

| | | | | |
|---|---|---|---|---|
| 5,351,935 | * | 10/1994 | Miyoshi et al. | 251/129.11 |
| 5,435,519 | * | 7/1995 | Everingham | 251/129.15 |
| 5,494,255 | * | 2/1996 | Pearson et al. | 137/338 |
| 5,501,201 | | 3/1996 | Miyoshi et al. | 123/568.24 |
| 5,680,880 | * | 10/1997 | Miyake et al. | 251/129.11 |
| 6,089,536 | * | 7/2000 | Watanabe et al. | 251/129.11 |

FOREIGN PATENT DOCUMENTS

| | | |
|---|---|---|
| 7-27023 | 1/1995 | (JP) . |
| 9-151811 | 6/1997 | (JP) . |

* cited by examiner

*Primary Examiner*—Andrew M. Dolinar
*Assistant Examiner*—Arnold Castro
(74) *Attorney, Agent, or Firm*—Sughrue Mion, PLLC

(57) ABSTRACT

A flow control valve is provided with a spring which is compressed in the direction of closure of the valve which opens and closes the valve housing, a protruded part which projects towards the valve drive side into the indented part provided on the upper surface of the bracket mounted on the valve drive housing, a protective member projecting from the valve drive housing towards the bracket, and an aperture formed in the bracket so as to communicate the lower face of the bracket with the outside. As a result, a reduction in the adverse effects of heat from the valve housing and in the entry of foreign objects from outside is achieved.

10 Claims, 9 Drawing Sheets

| TERMINAL / PHASE | ① | ③ | ④ | ⑥ |
|---|---|---|---|---|
| 0 | ON | OFF | OFF | ON |
| 1 | ON | OFF | ON | OFF |
| 2 | OFF | ON | ON | OFF |
| 3 | OFF | ON | OFF | ON |

FLOW CONTROL VALVE

FIELD OF THE INVENTION

The present invention relates to a flow control valve used in devices such as exhaust gas re-circulation control devices for the purpose of reducing exhaust gas emissions of $NO_x$ or the like from internal combustion engines.

BACKGROUND OF THE INVENTION

FIG. 1 shows an exhaust gas re-circulation control device. In FIG. 1, reference numeral 1 denotes an internal combustion engine, 2 is an intake pipe allowing inflow if air to the engine, 3 is an intake manifold allowing inflow if air to each pipe branching from the intake pipe 2, 4 is an air cleaner provided upstream of the intake pipe 2, 5 is an injector which is provided in the intake pipe 2 and injects fuel. Air entering the intake pipe 2 through the air cleaner 4 flows into the engine 1 together with fuel supplied from the injector 5.

6 represents a throttle valve which varies the degree of air intake into the engine 1 and 7 is a idle rotation speed control valve provided in the passage which bypasses the throttle valve 6. The gas mixture which enters the engine 1 is ignited by an ignition plug not shown in the figure. After combustion, the exhaust gases are expelled into the atmosphere through the exhaust pipe 8 after being purified in the purification device 9 comprised by a catalytic converter. 10 is a flow control valve which is disposed in the exhaust gas re-circulation passage 17 which is connected to the inlet and outlet sides of the intake manifold 3 The flow control valve drives the stepping motor which controls the flow of exhaust gases.

11 is an electronic control unit which generates control signals to the flow control valve 10 on the basis of information received from the driving state detection means comprised of elements such as a throttle aperture sensor 12 which detects the degree of aperture of the throttle valve 6, a pressure sensor 13 which detects the pressure in the intake pipe, a water temperature sensor 14 which detects the temperature of the engine cooling water, and the ignition device made up of the ignition coil 15 and the igniter 16.

FIG. 2 is a front view showing the above flow control valve, FIG. 3 is a longitudinal section view of FIG. 2 taken along the line A—A. 21 is a valve housing having an inlet port 21*a* which communicates with the engine exhaust gas pipe 8, an outlet port 21*b* which communicates with the engine inlet pipe 2 and a passage 21*c* between the inlet port 21*a* and the outlet port 21*b*. 22 is a valve seat provided in the passage 21*c* of the valve housing 21. 23 is a valve body which opens and closes the aperture of the valve seat 22. 24 is a valve shaft on one end of which the valve body 23 is mounted and which displaces the valve body 23 to the open and closed position by reciprocating motion as a valve rod. 25 is a bush which acts as a bearing for the valve shaft 24 mounted in the valve housing 21. 27 is a spring holder mounted on the other end of the valve shaft 24 which projects externally from the valve housing 21.

28 is a bracket formed as a unit with the valve housing 21 by cast iron for example on the side from which the valve shaft 24 projects from the valve housing 21. The bracket 28 is a cup shaped element of a fixed height which is sunken in a truncated cylindrical concave shape on the step motor 29 side.

A flange element 28*b* which mounts the stepping motor 29 is formed on the stepping motor 29 side of the bracket 28 through the holder 30. A screw hole 28*c* which hinges the mounting screw 32 is provided in the flange 28*b*. The cross sectional size of the flange 28*b* is of a size having the minimum necessary strength to support the stepping motor 29 or is a slightly larger size (for example a size having a surface area twice that of the necessary strength.)

Furthermore in the bracket 28, a large aperture 28*d* is formed which communicates with the lower face of the indented part 28*a* and, on the valve housing side 21 of the bracket 28, there is a holder 26 which prevents the build-up of deposits within the vertical range of the bush 25 displaced by the valve shaft 24.

The motor holder 30 is made from material having good thermal conductivity. A cylindrical member 35 which is suspended into the inner part of the indented part 28*a* of the bracket 28 is formed so as to cover the outside of the coil spring 52 and the spring holder 27. A plurality of heat radiating fins 35*a* are provided on the outside face of the cylindrical member 35.

Next the components of the stepping motor 29 will be explained. 36 is a hollow motor housing, 37 is a rotor which is supported in free rotation by an upper bearing 38 and a lower bearing 33 at its upper and lower ends. A magnet 39 is mounted on its outside periphery. The central part of the rotor 37 is hollow, displaces vertically and has a threaded section 37*a* formed on its inner face.

40*a* and 40*b* are upper and lower yokes which are mounted on the inner part of the motor housing 36 so as to face the magnet 39 of the rotor 37 and in the inner part of which are housed bobbins 41*a* and 41*b*. 42*a*1 and 42*a*2 are coils wound around the bobbin 41*a*, 42*b*1 and 42*b*2 are coils wound around the bobbin 41*b* and 43 is a plate magnetically separating the upper and lower yokes 40*a* and 40*b*. 44 is an upper bearing seat 45 is an actuator rod which is supported in a hinged state by the threaded section 37*a* of the inner part of the rotor 37 and projects downwardly from the motor holder 30. The tip of the actuator rod 45 displaces vertically and pushes against the valve shaft 24.

Due to the fact that the actuator rod 45 is prevented from rotating by the bearing of the actuator rod and the motor bush 54 which has a rotation prevention function, the actuator rod displaces vertically in response to the rotation of the rotor 37. A stopper 45*b* is provided in the actuator rod which contacts with and detaches from the stopper 37*b* of the rotor 37 and limits displacement above a fixed amount. 46 is a SPL washer for providing pre-load to the lower bearing 33. 51 is a connector which supplies electrical pulses to each coil.

As shown in FIG. 4, the connector 51 comprises the terminals $\hat{1}$–$\hat{6}$ which are electrically connected to the coils 42*a*1, 42*a*2, 42*b*1, 42*b*2, and the connector housing 51*a*. Transistors Tr1–Tr4 are connected on the earthing line of the terminals $\hat{1}$, $\hat{3}$, $\hat{4}$, $\hat{6}$.

Terminal $\hat{2}$ one end of which is connected to the coils 42*a*1 and 42*a*2 and terminal 5 one end of which is connected to coils 42*b*1 and 42*b*2 are connected to the electrical supply terminal +B through the switch SW. The connector housing 51*a* and the motor housing 36 are formed as a unit by resin.

52 is a coil spring which intercalates between the spring holder 27 and the bracket 28. The coil spring pushes the valve shaft 24 upwardly towards the middle of the figure against through the spring holder 27 and maintains the valve body 23 in a closed state. While in a closed state, a gap is formed between the valve shaft 24 and the actuator rod 45 and the valve body 23 is maintained in an accurately closed state.

Next the operation of the flow control valve will be explained. The rotor 37 of the stepping motor 29 which acts as a motive source does not rotate continuously but only makes a single rotation. Firstly if an electrical current is applied to the top of the coils 42*a*1 and 42*a*2 in an anti-clockwise direction viewed from above, the upper face of the coils will be a north pole N, the lower face will be a south pole S and the stator will be a north pole. In the same way if a current is applied to the lower face of the coils 42*b*1 and 42*b*2, a magnetic pole will be generated in the stator. As a magnet is provided which is minutely divided into S poles and N poles in the rotor, it is stabilized in the stator. Actually as shown in FIG. 5 one step at a time is rotated by changing the phase in a sequential manner. For example when the valve body 23 is opened, the phase is changed in the sequence 0→1→2→3→0→1, when in the closed position the phase is changed in the sequence 0→3→2→1→0→3.

In response to the rotations of the rotor 37, the actuator rod 45 which is hinged to the threaded section 37*a* of the rotor 37 moves downwardly in the figure, is repelled by the elastic force of the coil spring 52 which is compressed between the bracket 28 and the spring holder 27, displaces the valve shaft 24 downwardly and opens the valve body 23.

In such a way, the flow of the high temperature engine exhaust gases on the inlet port side 21*a* of the housing 21 is controlled by the valve body 23 and is directed to the outlet port side 21*b* through the passage 21*c*.

Furthermore since generating poles of the stator rotate in the opposite direction if the conducting phase order with respect to the coils 42*a*1, 42*a*2, 42*b*1, 42*b*2 is changed, the rotor 37 is rotated in the opposite direction to the above. In response to the direction of rotation of the rotor 37, the actuator rod 45 displaces upwardly towards the middle of the figure. As a result, the valve shaft 24 displaces upwardly towards the middle of the figure due to the coil spring 52 and the valve 23 closes. When the stopper 45*b* reaches the stopper 37*b* of the rotor 37, the displacement of the actuator rod 45 terminates.

Since the conventional flow control valve is constructed as above, the cylindrical member 35 covers the periphery of the actuator rod 45 and the valve shaft 24 and has the function of protecting the slidable parts of the stepping motor 29 and the valve housing 21 from foreign objects. In other words, foreign objects such as dust or muddy water penetrate from the aperture 28*d* into the indented part 28*a* of the bracket 28. Such foreign objects try to enter the slidable parts of the valve shaft 24 and the bush 25 or the hinged part of the actuator rod 45 and the rotor 37. However since the periphery of the actuator rod 45 and the valve shaft 24 is covered by the cylindrical member 35, the foreign objects can not reach the above regions and the lodgment or deposition of outside objects into the slidable or hinged parts of the valve shaft 24 or the actuator rod 45 is prevented.

In order to prevent the entry of outside objects such as dust or muddy water into the valve shaft or the spring on its periphery, the tip of the cylindrical member must abut closely with the lower face of the indented part 28*a* of the bracket 28 (hereafter called the lower face of the bracket), and totally close the gap L1. However closing the gap L1 creates the problems of the application of radiant heat from the valve housing side 21 or the liability to heating.

As a solution to this problem, an aperture 28*d,* provided in the bracket, on the side of the motor separated from the lower face of the bracket has been provided. However even though the tip of the cylindrical member is separated from the valve housing, it is possible to prevent the entry of foreign objects by the bracket itself. On the other hand water which has penetrated the lower face of the bracket accumulates and enters one end of the coil spring which leads to the generation of rust and reductions in durability.

The present invention is proposed to solve the above problems and reduce both the effect of heat from the valve housing and undesirable effects due to the penetration of foreign objects by the provision of a member on the periphery of the spring such as a spring seat.

DISCLOSURE OF THE INVENTION

The present invention comprises a flow control valve which has a valve housing having a passage between the inlet port communicating with the engine exhaust pipe, the outlet port communicating with the engine intake pipe and the inlet and outlet ports, a valve body which opens and closes the aperture of the valve seat provided in the passage of the valve housing, a valve shaft which displaces the valve body reciprocally in the open and closed position, a sprig which is compressed in the direction of closure of the valve body, a valve motive housing which is mounted on the valve housing through the bracket which is formed as a unit with the valve housing, and the valve motive part which pushes the valve shaft and opens the valve body. The present invention is further comprised of a protruded part which is protruded to the valve motive housing side in a indented part provided on the bracket upper surface, a preserved member which forms a housing space for the spring with the protruded part and protrudes from the valve motive housing to the bracket, and an scupper which is formed on the bracket so as to link the bottom of the indented part provided on the upper surface of the bracket with the outside. Thus it is possible to enlarge the gap between the tip of the cylindrical member and the lower surface of the bracket and to decrease heat conduction from the valve housing to the cylindrical member.

Moreover it is possible to ensure the protection of sliding parts and the like from foreign bodies because the protruded part and the protective member cover the periphery of the valve shaft and the actuator rod. Thus water seeping in from the heat radiation aperture of the bracket flows out from the scupper formed at the lower part to the outside and does not accumulate. Furthermore since the protruded part is higher than the lower face, the spring is neither flooded nor has a lessened life span.

Hence it is possible to simplify the structure of the bracket because the invention is provided with a spacing member which is interposed between the bracket and the valve motive housing.

The freedom with respect to the length of the spacing member is increased because the dimension from the lower surface of the indented part on the top of the protruded part is bigger than the top of the scupper and smaller than the dimension of the heat radiation aperture.

Since this invention is provided with a radiating fin on the outer peripheral surface of the protective member, the heat radiation efficiency of the protective member is increased and the heat effects on the motor are efficiently decreased.

This invention is provided with a tapered part on the aperture which links the bottom of the indented part and the outside. Therefore it is easy to take a mold and drain water.

PREFERRED EMBODIMENTS OF THE INVENTION

In order to explain the invention in more detail, the preferred embodiments will be explained with reference to the accompanying drawings.

Embodiment 1

Figure 6:
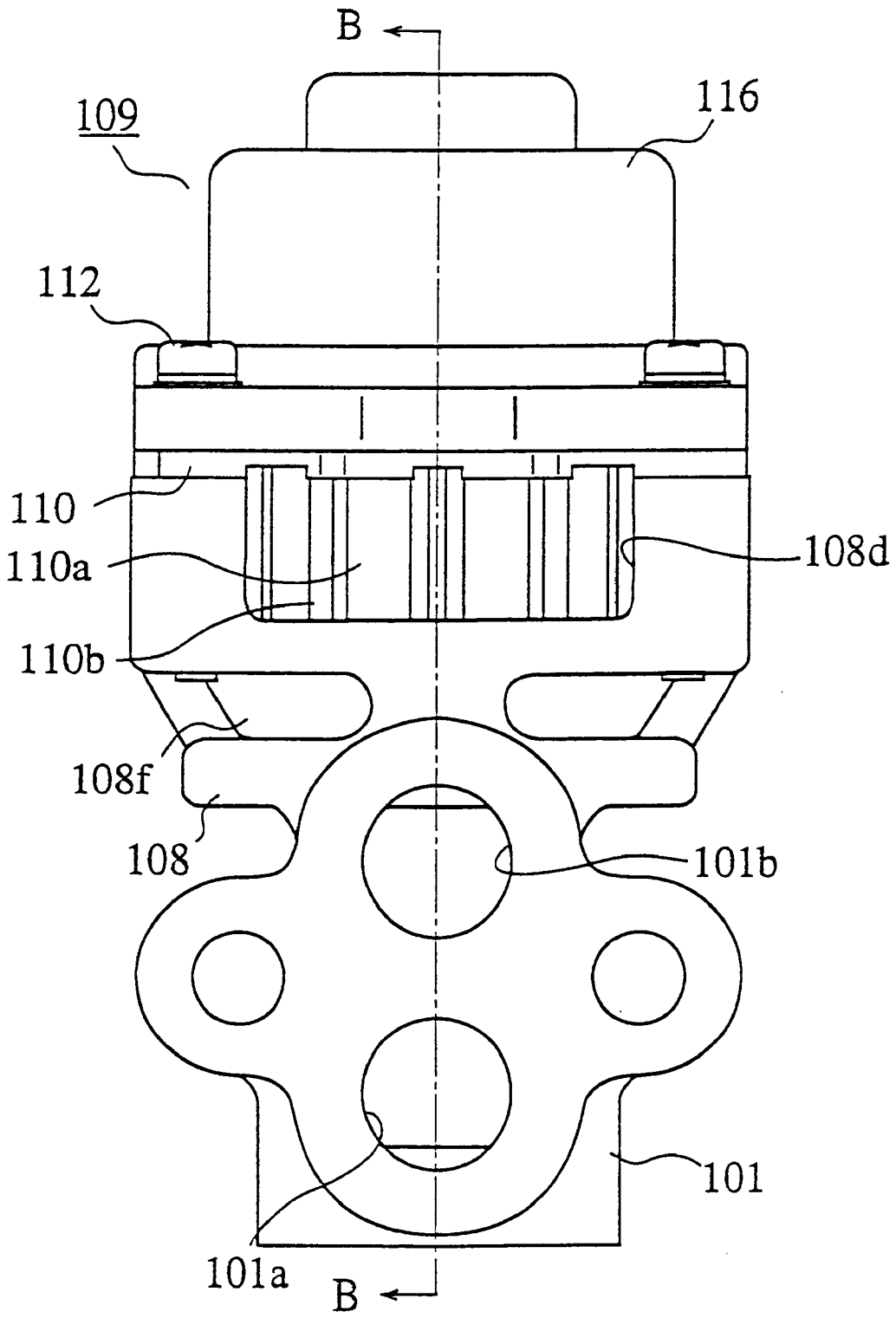
FIG. 6 is a front view of a flow control valve in accordance with embodiment 1 of the invention.
Figure 7:
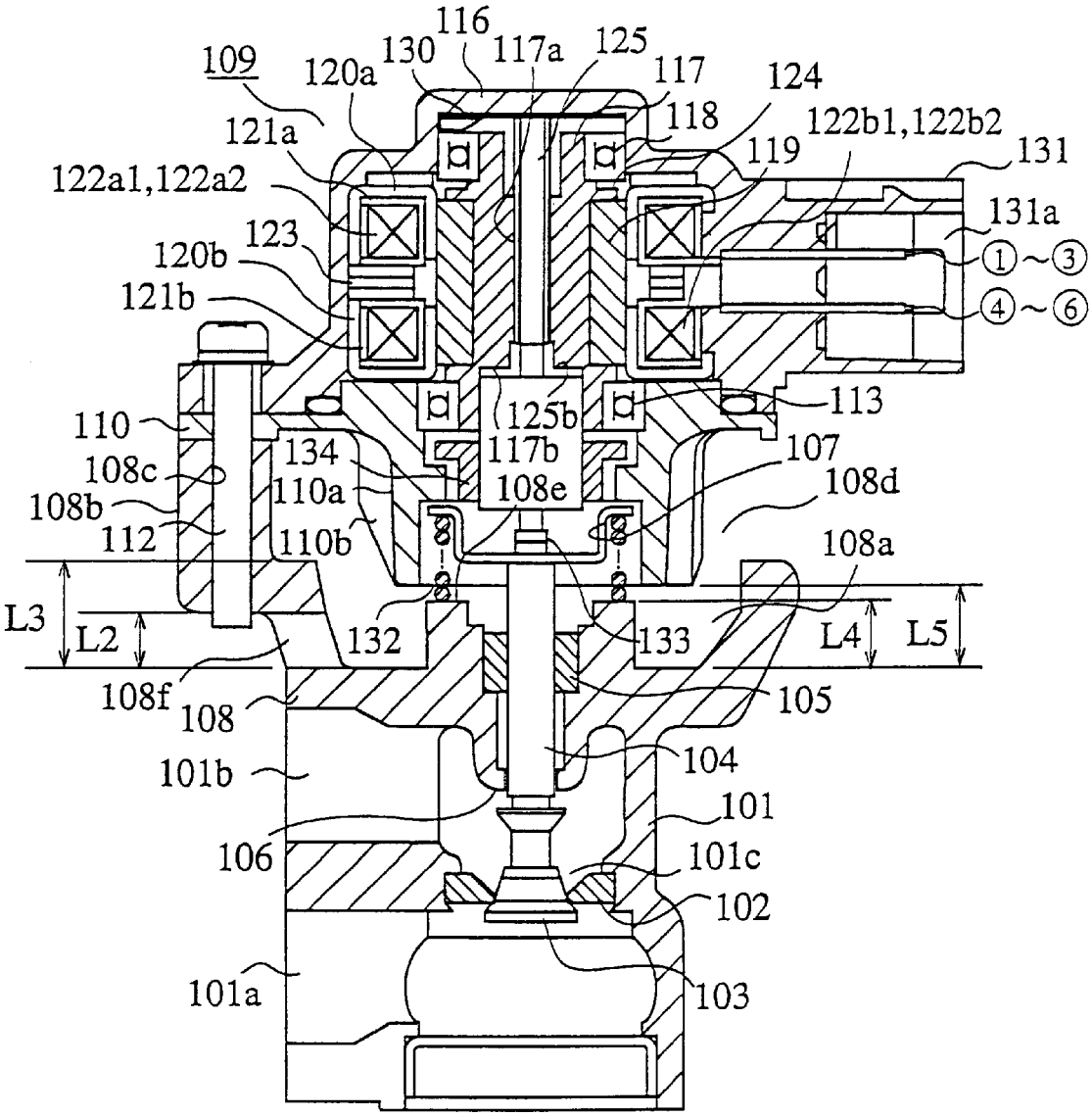
FIG. 7 is a longitudinal sectional view of FIG. 6 taken along the line B—B.

FIG. 6 is a front view of a flow control valve in accordance with embodiment 1 of the invention, FIG. 7 is a longitudinal sectional view of FIG. 6 taken along the line B—B. In the Figures, reference numeral 101 is a valve housing, for example formed out of cast iron, which has an inlet port 101*a* which communicates with the engine 1 exhaust gas pipe 8, an outlet port 101*b* which communicates with the inlet pipe 2 of the engine 1 and a passage 101*c* between the inlet port 101*a* and the outlet port 101*b*. 102 is a valve seat provided in the passage 101*c* of the valve housing 101. 103 is a valve body which opens and closes the aperture of the valve seat 102. 104 is a valve shaft also called a valve rod or a valve spindle on one end of which the valve body 103 is mounted and which displaces the valve body 10 in the open and closed position by reciprocal motion. 105 is a bush which acts as a bearing for the valve shaft 104 mounted in the valve housing 101. 107 is a spring holder mounted on the other end of the valve shaft 104 which projects externally from the valve housing 101. 108 is a bracket which shows a part of a stepping motor side 109 of the valve housing 101. This bracket 108 is a concavity dent which shapes the motive part and this stepping motor side 109 like a cut tip of a circular cone as a fixed height cup (hereafter called the indented part 108*a*, the lower face of the indented part 108*a* called the lower face of the bracket).

A flange element 108*b* which mounts the stepping motor 109 is formed on the stepping motor 109 side of the bracket 108 through the motor holder 110 which acts as a valve motive part housing. A screw hole 108*c* which hinges the mounting screw 112 is provided in the flange 108*b*. The cross sectional size of the flange 108*b* is of a size having the minimum necessary strength to support the stepping motor 109 or is of a slightly larger size Furthermore, the heat radiation aperture 108*d* which communicates with the indented part 108*a* is formed in the flange 108*b*. In the outside face of the bracket, there is a scupper 108*f* which communicates the lower face of the bracket to the outside. On the valve housing side 101 of the bracket 108, there is a holder 106 which prevents the build-up of deposits within the vertical range of the bush displaced by the valve shaft 104.

The motor holder 110 is made from material having good thermal conductivity. A cylindrical member 110*a*, which acts as a protective member and which is suspended into the inner part of the indented part 108*a* of the bracket 108 is formed so as to cover the outside of the spring holder 107 and the coil spring 132. A plurality of heat radiating fins 110*b* are provided on the outside face of the cylindrical member 110*a*.

Whereas in the middle of the lower face of the bracket, a spring seat 108*e* which acts as a protruded part to the motor holder side is protruded to cover a part of the valve shaft 104. The protrusion length L4 of the spring seat 108*e* is larger than the scupper length L2 from the lower face of the bracket and is smaller than the length L3 which is from the lower face of the bracket to the heat radiation aperture 108*d*. That is to say L2<L4<L3. As a result, in the range of 0<L5<L3, it is possible to get a bigger degree of freedom in the establishment of the length L5 which is from the lower face of the bracket to the cylindrical member, and it is easy to design and reduce the size of the device.

Next the components of the stepping motor 109 will be explained. 116 is a hollow motor housing, 117 is a rotor which is supported in free rotation by an upper bearing 118 and a lower bearing 113 at its upper and lower ends. A magnet is mounted on its outside periphery. The central part of the rotor 117 is hollow, displaces vertically and has a threaded section 117*a* formed on its outside face.

120*a* and 120*b* are upper and lower yokes which are mounted on the inner part of the motor housing 116 so as to face the magnet 119 of the rotor 117 and in the inner part of which are housed bobbins 121*a* and 121*b*. 122*a*1 and 122*a*2 are coils wound around the bobbin 121*a*, 122*b*1 and 122*b*2 are coils wound around the bobbin 121*b*, 123 is a plate separating the upper and lower yokes 120*a* and 120*b*. 124 is an upper bearing seat 118, 125 is an actuator rod which is supported in a hinged state by the threaded section 117*a* of the inner part of the rotor 117, which projects downwardly from the motor holder 110, which displaces vertically and which pushes against the valve shaft 104.

Figure 1:
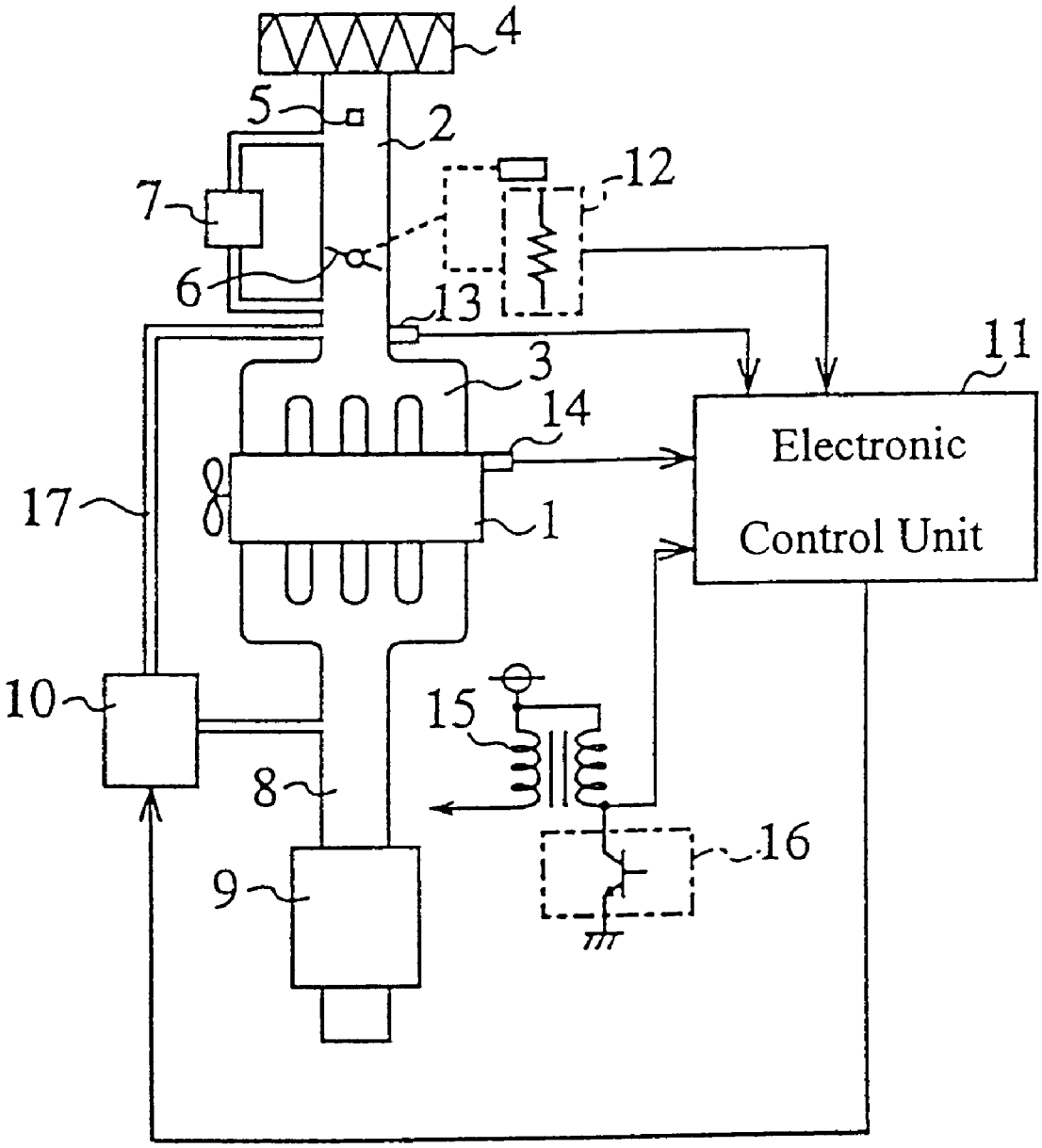
FIG. 1 PRIOR ART
FIG. 1 is a view which shows an exhaust gas re-circulation control device.
Figure 2:
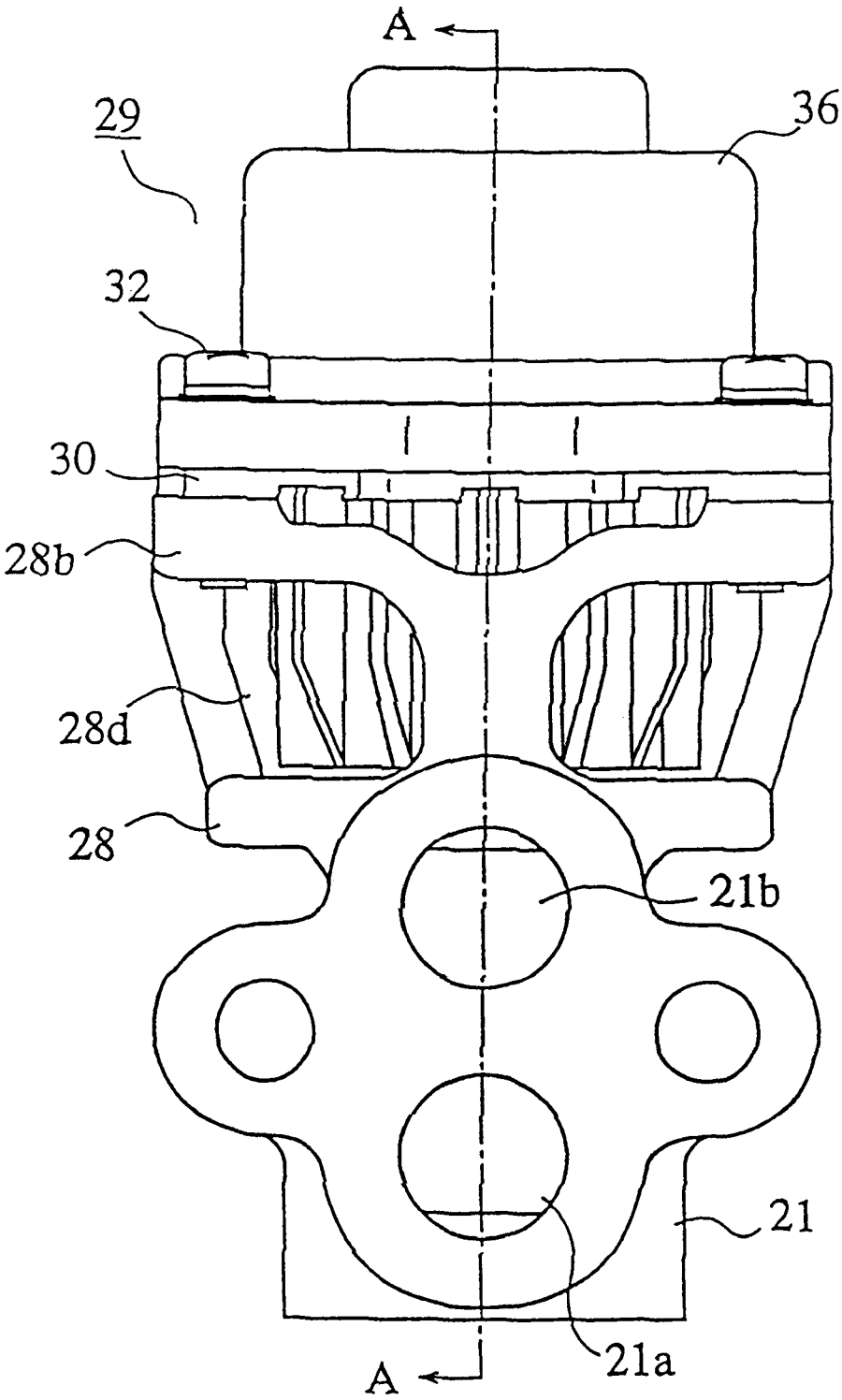
FIG. 2 PRIOR ART
FIG. 2 is a front view of a conventional flow control valve.
Figure 3:
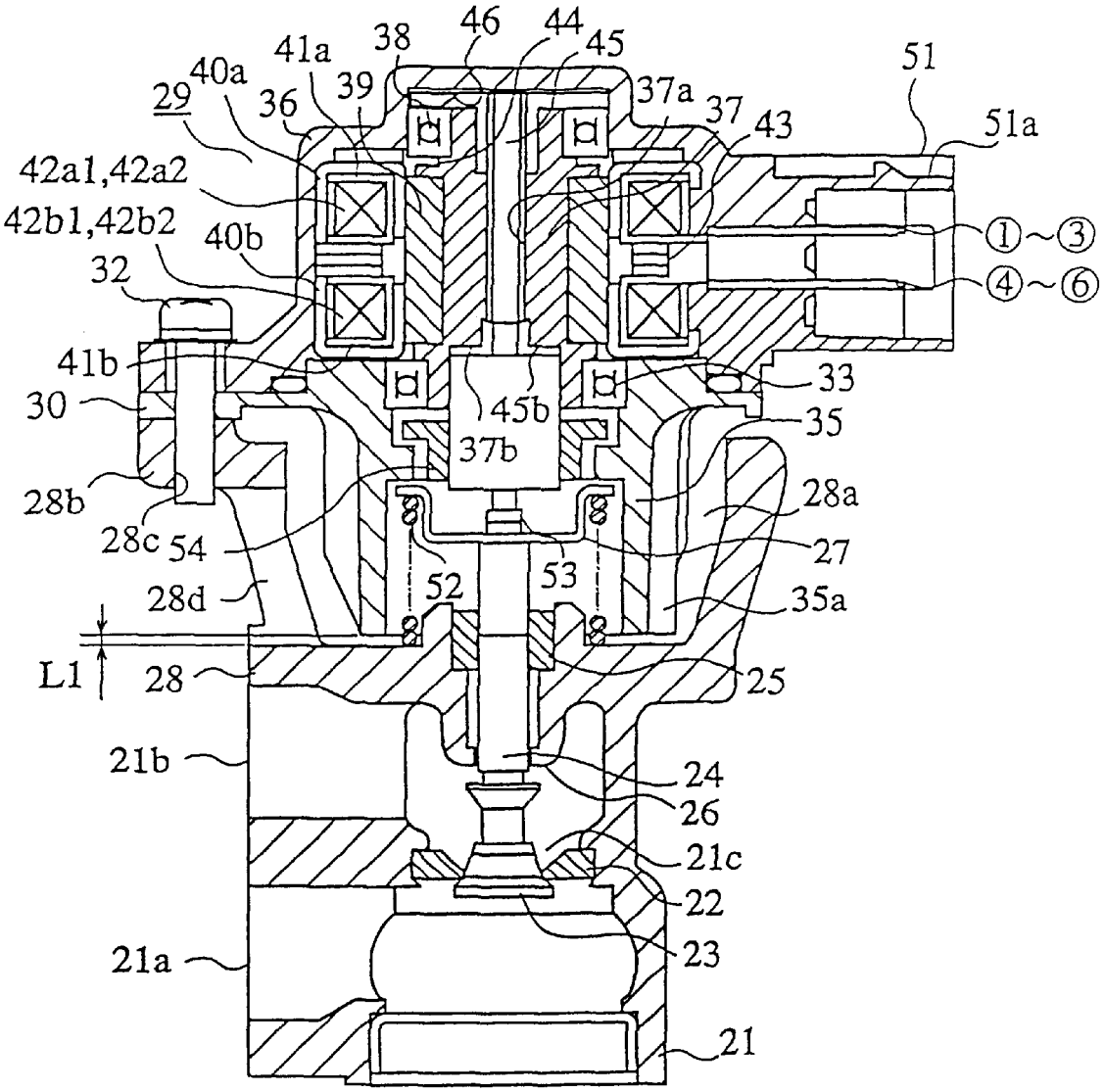
FIG. 3 PRIOR ART
FIG. 3 is a longitudinal section view of FIG. 2 taken along the line A—A.
Figure 4:
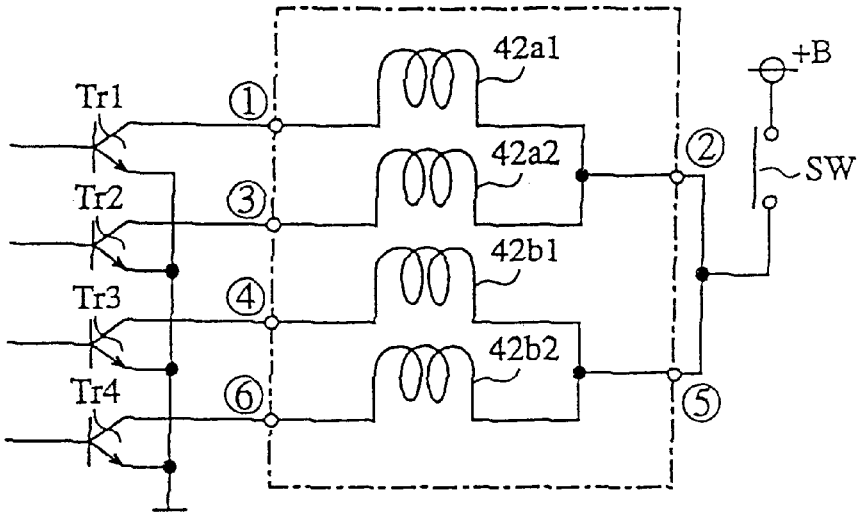
FIG. 4 PRIOR ART
FIG. 4 is a connection diagram of a motor coil.

Due to the fact that the actuator rod 125 is prevented from rotating by the bearing of the actuator rod and the motor bush 134 which has a rotation prevention function, the actuator rod displaces vertically in response to the rotation of the rotor 117. A stopper 125*b* is provided in the actuator rod 125 which contacts with and detaches from the stopper 117*b* of the rotor 117 and limits displacement above fixed amount. 130 is a SPL washer for providing pre-load to the lower bearing 113. 131 is a connector which supplies electrical pulses to each coil. As shown in FIG. 4, the connector 131 comprises the terminals $\hat{1}$~$\hat{6}$ which are electrically connected to the coils 122*a*1, 122*a*2, 122*b*1, 122*b*2, the electrical supply terminal +B, and the connector housing 131*a*.

132 is a coil spring which intercalates between the spring holder 107 and the bracket 108. The coil spring pushes upwardly towards the middle of the figure against the valve shaft 104 through the spring holder 107 and maintains the valve body 103 in a closed state. While in a closed state, a gap 133 is formed between the valve shaft 104 and the actuator rod 125 and the valve body is maintained in an accurately closed state.

Figure 5:
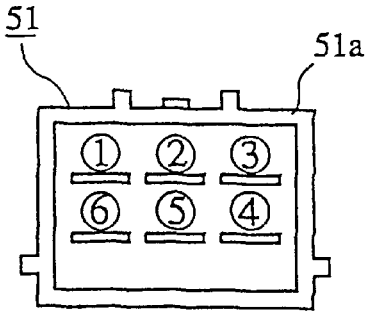
FIG. 5 PRIOR ART
FIG. 5 is an electric phase diagram of a coil.

Next the operation of the flow control valve will be explained. As shown in FIG. 5 the rotor 117 is rotated one step at a time by changing the phase to the coils 122*a*1, 122*a*2, 122*b*1, 122*b*2 in a sequential manner.

The actuator rod 125 which is hinged to the threaded section 117*a* in the rotor's central section for example displaces downward in the figure, is repelled by the elastic force of the coil spring 132 which is compressed between the bracket 108 and the spring holder 107, displaces the motor shaft 104 downwardly and opens the valve body 103. In such a way, the flow of the high temperature engine exhaust gases on the inlet port 101*a* side of the housing 101 is controlled by the valve body 103 and is directed to the outlet port side 101*b* through the passage 101*c*.

Furthermore since the generating poles of the stator are rotated in the opposite direction by changing the conducting phase order with respect to the coils 122*a*1, 122*a*2, 122*b*1, 122*b*2, the rotor 117 is rotated in the opposite direction to the above. In response to the direction of rotation of the rotor 117, the actuator rod 125 displaces upwardly towards the middle of the figure. As a result the valve shaft 104 displaces upwardly towards the middle of the figure due to the coil spring 132 and the valve closes. And when the stopper 125*b* reaches the stopper 117*b* of the rotor 117, the displacement of the actuator rod 125 terminates.

Considering the above, in accordance with embodiment 1 of the invention, the spring seat which is protruded to the motor holder side in the middle of the lower face of the bracket and the cylindrical member which is protruded from the motor holder to the bracket side, in order to cover the periphery of the spring which was supported by the spring seat. A space is formed in which the spring is stored and a scupper is formed in the bracket so as to communicate the indented part of the bracket with the outside. As a result, it is possible to enlarge the gap between the tip of the cylindrical member and the lower face of the bracket, and decrease the effect of radiant heat from the valve housing to the cylindrical member.

Moreover it is possible to ensure the protection of the sliding parts from foreign bodies because the spring seat and the cylindrical member cover the periphery of the spring, the valve shaft and the actuator rod. Thus water seeping from the radiation aperture of the periphery face of the bracket flows out from the scupper formed at the lower part of the indented part of the bracket to the outside and does not accumulate.

Furthermore the space for housing the spring is higher than the lower face of the bracket, the spring is not flooded, it prevents the growth of rust and is possible to elevate its durability.

Embodiment 2

Figure 8:
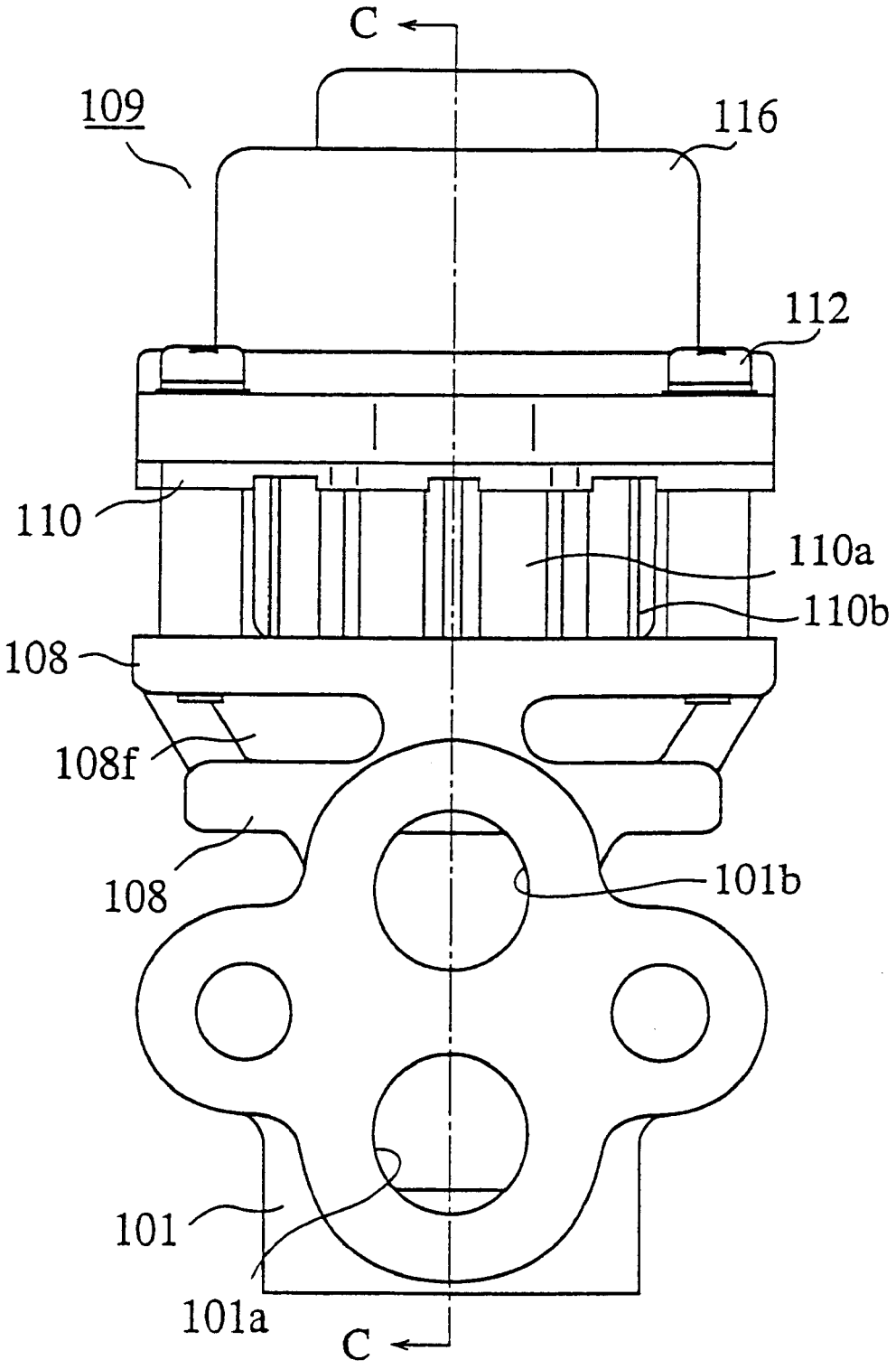
FIG. 8 is a front view of the flow control valve in accordance with embodiment 2 of this invention.
Figure 9:
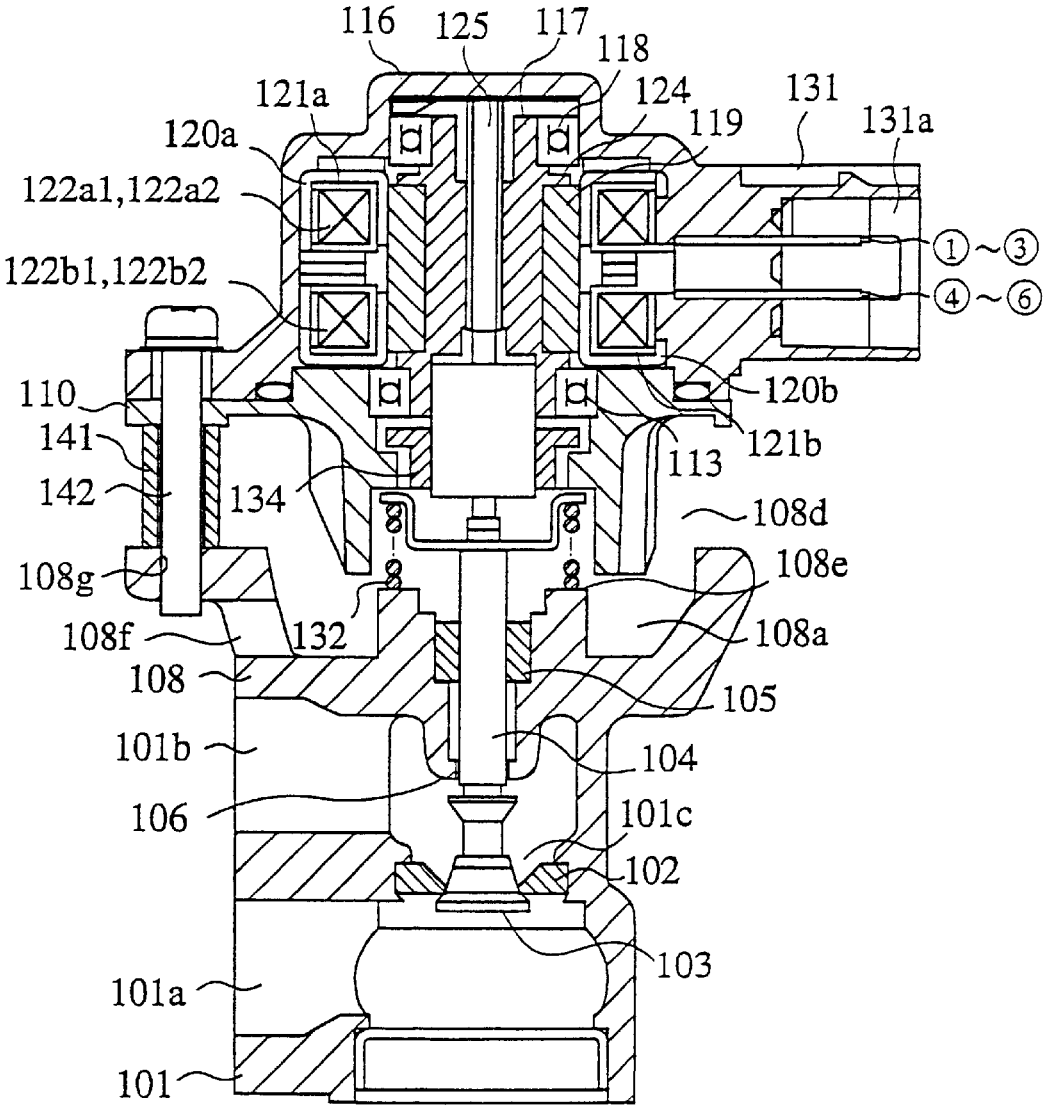
FIG. 9 is a longitudinal sectional view of FIG. 8 taken along the line C—C.

FIG. 8 is a front view of a flow control valve in accordance with embodiment 2 of the invention, FIG. 9 is a longitudinal sectional view of FIG. 8 taken along the line C—C. In the Figures, the cylindrical spacing member 141 is interposed between the bracket 108 formed as a unit with the valve housing 101 and the motor holder 110. It is the strong point which fixes the motor housing 116 and the motor holder 110 to the bracket 108 formed as a unit with hinging the communicated motor housing 116, the hole of the flange part of the motor holder 110 and the screw 142 as an installation member which passes through the spacing member 141 to the screw hole 108*g* of the bracket 108. The other formations are the same as FIG. 7, the same parts are marked as the same numbers and the duplicated explanation is omitted.

Considering the above, in accordance with embodiment 2 of the invention, it is possible to simplify the formation of the bracket which formed as a unit with the valve housing because the motor holder 110 is mounted on the valve housing 101 through the spacing member 141.

Furthermore it is possible to reduce the heat conduction of the valve housing and the motor holder because using a low thermal conductivity material for example ceramic, heat-resistant resin and so on for the spacing member.

Embodiment 3

In accordance with embodiment 3 of the invention, as in embodiment 1 or 2, a side fin or spiral formed heat radiating fin 110*b* is provided on the outside face of the cylindrical member 110*a*, considering the flow of air in the bracket 108. The other formations are the same , the same parts are marked with the same numbers as in embodiment 1 or 2, and their explanation is omitted.

Considering the above, in accordance with embodiment 3 of the invention, it is possible to improve heat radiation and efficiently decrease the effect of heat on the motor side because the heat radiating fin is provided on the outside face of the cylindrical member.

Moreover the above embodiment illustrates the drawing type of valve which is in the closed condition when the valve spindle is pulled up. However it is possible to use the pulling down style valve which is in the closed condition when the valve spindle is pulled down.

Furthermore the above embodiment explains the electric control valve using the stepping motor, however it is possible to use a diaphragm control valve using the air presser or other control valves.

It is effective to use an electric control valve using a stepping motor because the stepping motor is sensitive even to very low heat.

The above embodiment explains a flow control valve in which one valve is installed with a valve spindle. However it is possible to use a double valve style flow control valve on which two valves are installed with valve spindles.

Embodiment 4

Figure 10:
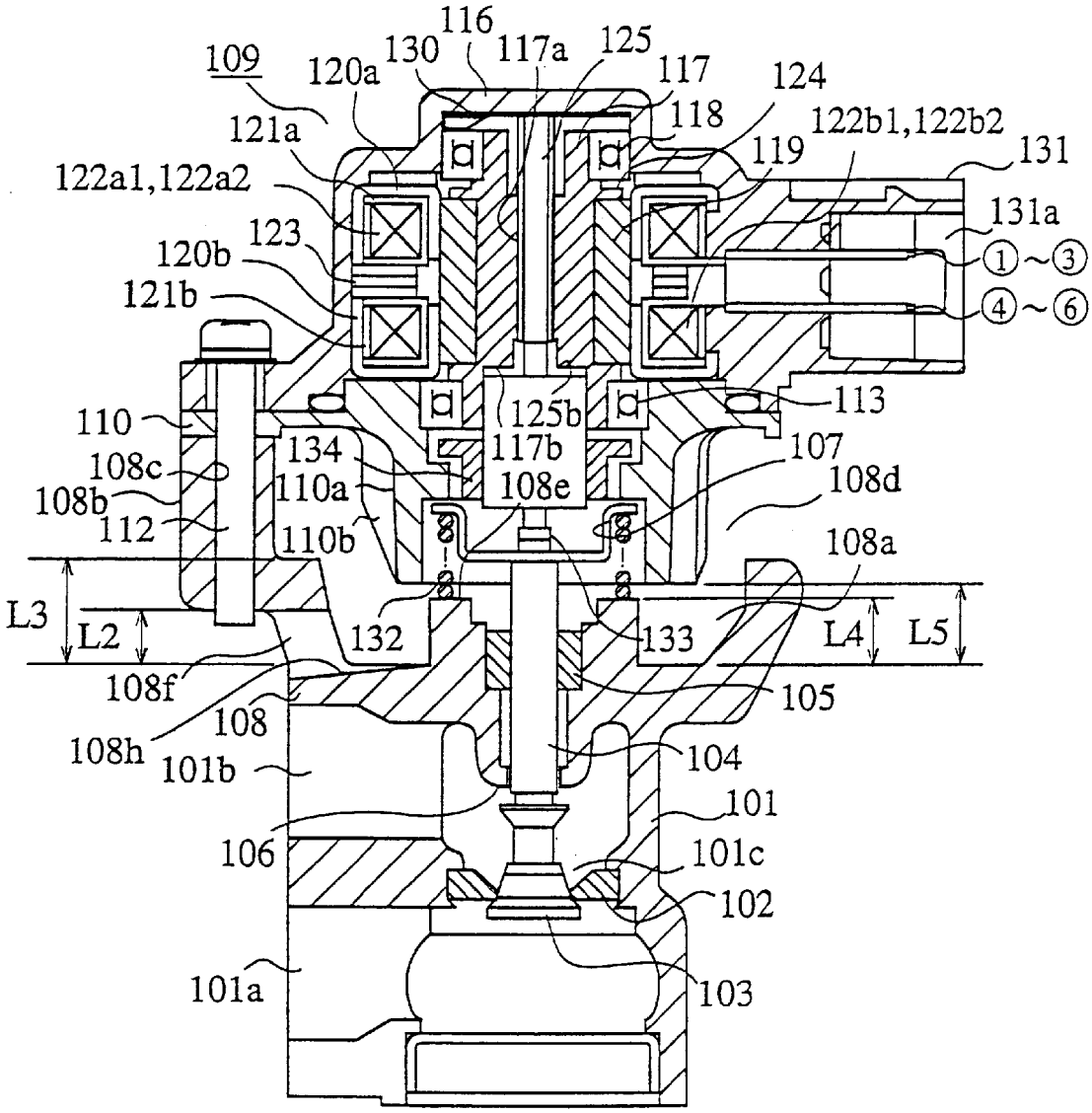
FIG. 10 is a longitudinal sectional view of the flow control valve in accordance with embodiment 4 of this invention.

In accordance with embodiment 4 of the invention as shown in FIG. 10, in embodiment 1, 2 or 3, a tapered part 108*f* having a slope is provided inside the scupper 108*f*. It is easy to take a mold out when the bracket 108 is formed by cast iron and to drain the water off from the scupper 108*f*.

Industrial Applicability

As shown above, the flow control valve in accordance with the present invention, it is placed in the exhaust gas pathway and controls the flow of the exhaust gas. Therefore it decreases the heat influence from the valve housing and the adverse effects of foreign bodies which enter from the outside.

What is claimed is:

1. A flow control valve comprising:

a valve housing with an inlet port, an outlet port, and a passage provided between the inlet port and the outlet port;

a valve body provided in the passage of the valve housing;

a valve shaft on which is mounted the valve body and which displaces the valve body to open and close the passage, the valve shaft extending in an up-down direction;

a spring which influences the valve body to close the passage;

a valve drive housing mounted on the valve housing; and a valve drive part provided in the valve drive housing for pushing the valve shaft and the valve body against the influence of the spring to open the passage, wherein the valve housing includes (1) an indented part with a depressed surface that faces towards the valve drive housing, (2) a protruding part that extends from the depressed surface towards the valve drive housing, and (3) an aperture formed in the indented part so as to communicate the depressed surface with the outside, wherein the valve drive housing includes a protective member that protrudes towards the valve housing, and wherein one end of the spring is supported by the protruding part of the valve housing, so that, as compared to an upper most point of the aperture, the one end of the spring is positioned in the up-down direction further away from the depressed surface.

2. A flow control valve according to claim 1, wherein a lower most point of the aperture is one of (i) coplanar with the depressed surface and (ii) positioned further from the valve drive housing in the up-down direction than the depressed surface.

3. A flow control valve according to claim 1, further comprising:

a spacing member interposed between the valve housing and the valve drive housing.

4. A flow control valve according to claim 1, wherein the indented part includes a heat radiating aperture, and wherein, as compared to the one end of the spring, the heat radiating aperture is positioned further from the depressed surface in the direction toward the valve drive housing.

5. A flow control valve according to claim 3, wherein the indented part includes a heat radiating aperture, and wherein, as compared to the one end of the spring, the heat radiating aperture is positioned further from the depressed surface in the direction toward the valve drive housing.

6. A flow control valve according to claim 1, further comprising:

a heat radiating fin provided on an outer peripheral face of the protective member.

7. A flow control valve according to claim 3, further comprising:

a heat radiating fin provided on an outer peripheral surface of the protective member.

8. A flow control valve according to claim 1, wherein the aperture communicating the depressed surface of the indented part with the outside is tapered.

9. A flow control valve comprising:

a valve housing with an inlet port, an outlet port, and a passage provided between the inlet port and the outlet port;

a valve body provided in the passage of the valve housing;

a valve shaft supporting the valve body for displacing the valve body to open and close the passage, the valve shaft extending in an up-down direction; and a spring operatively coupled to the valve housing to influence the valve body to close the passage, wherein the valve housing includes (1) an indented part with a depressed surface, (2) a protruding part that extends from the depressed surface, and (3) an aperture formed in the indented part, and wherein one end of the spring is supported by the protruding part of the valve housing, so that, as compared to an upper most point of the aperture, the one end of the spring is positioned in the up-down direction further away from the depressed surface.

10. A flow control valve according to claim 9, wherein a lower most point of the aperture is one of (i) coplanar with the depressed surface and (ii) positioned further from the valve drive housing in the up-down direction than the depressed surface.

* * * * *